United States Patent [19]

Spliethoff et al.

[11] Patent Number: 4,981,089

[45] Date of Patent: Jan. 1, 1991

[54] PROCESS FOR THE REDUCTION OF NITROGEN MONOXIDE EMISSIONS DURING THE COMBUSTION OF SOLID FUELS

[75] Inventors: Heinz Spliethoff, Friedrichstahl; Hartmut Spliethoff, Stuttgart-Vaihingen, both of Fed. Rep. of Germany

[73] Assignee: Saarbergwerke Aktiengesellschaft, Saarbrucken, Fed. Rep. of Germany

[21] Appl. No.: 391,730

[22] Filed: Aug. 8, 1989

Related U.S. Application Data

[63] Continuation at Ser. No. 148,658, filed as PCT DE87/00186 on Apr. 28, 1987, published as WO87/06677 on Nov. 5, 1987, abandoned.

[30] Foreign Application Priority Data

Apr. 29, 1986 [DE] Fed. Rep. of Germany ..... 3614497

[51] Int. Cl.[5] ..... F23G 5/12

[52] U.S. Cl. ..... 110/229; 48/77; 48/101; 48/210; 110/345; 110/347

[58] Field of Search ..... 110/229, 230, 345, 347; 48/77, 101, 210

[56] References Cited

U.S. PATENT DOCUMENTS 4,231,302 11/1980 Linneborn ..... 110/229

4,417,528 11/1983 Vining et al. ..... 110/229

FOREIGN PATENT DOCUMENTS 369340 3/1932 United Kingdom .

647119 12/1950 United Kingdom .

OTHER PUBLICATIONS

Patent Abstracts of Japan, vol. 8, No. 20 (M-271) (1452), Jan. 27, 1984, Juukogyo et al.

*Primary Examiner*—Edward G. Favors

*Attorney, Agent, or Firm*—James Creighton Wray

[57] ABSTRACT

In a process to reduce the nitrogen monoxide emissions generated during the combustion of solid fuels, before the combustion takes place, the entire amount of solid fuel is degasified inside a performance combustion area (2). At least part of the gas obtained during the degasification of the solid fuel is utilized as reduction gas in one or several reduction areas (3) that have been placed following the performance combustion area (2). In an installation for the implementation of the process the degasification device for solid fuel has been configured as a degasification section (5) for the continuous passage of fuel and has been arranged inside the combustion unit (1), within the flue gas current.

19 Claims, 2 Drawing Sheets

Figure 1:
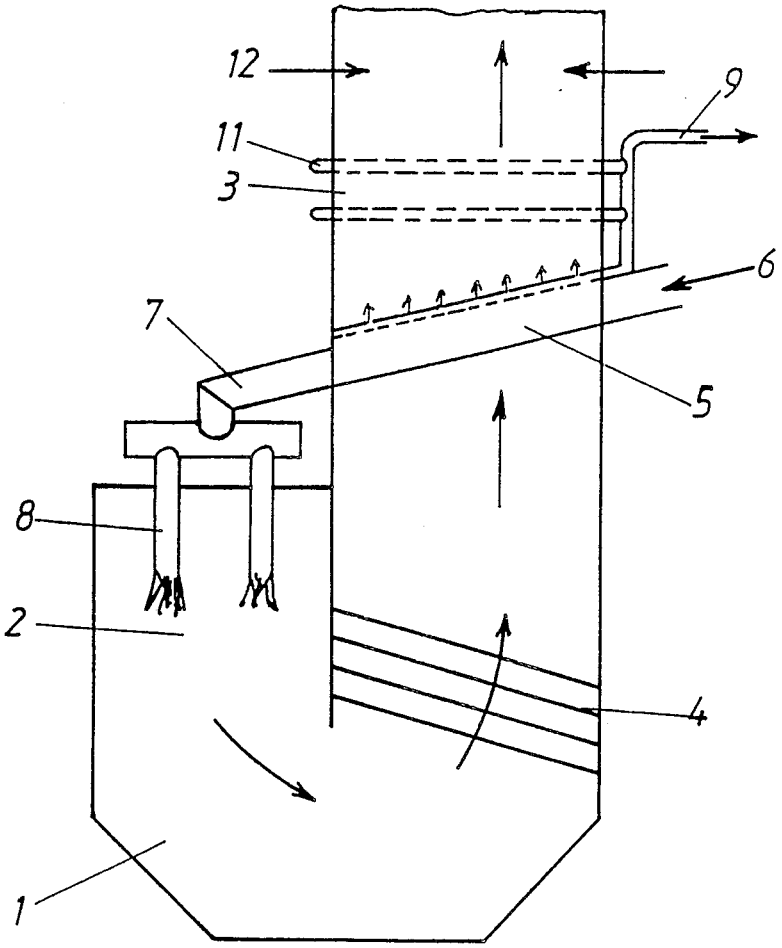

PROCESS FOR THE REDUCTION OF NITROGEN MONOXIDE EMISSIONS DURING THE COMBUSTION OF SOLID FUELS

This application is a continuation of application Ser. No. 148,658, filed as PCT DE87/00186 on Apr. 28, 1987, published as W087/06677 or Nov. 5, 1987, now abandoned.

The invention regards a process and a device for the reduction of nitrogen oxide emissions generated during the combustion of solid fuels, (especially of those fuels consisting of medium and highly volatile bituminous coal) in which at least one reduction area has been arranged following a performance combustion area.

For the reduction of nitrogen oxide emissions in large combustion units operated with solid fuels at least one reduction area that is fed reduction agents may be configured following the combustion area. The reduction material is preferably used in its liquid or gaseous state, since solid reduction agents do not always react fully and the residues, therefore, contain a high proportion of combustible reduction matter. On the other hand, the additional provision of, for example, combustion gas as a reduction gas for the operation of the reduction area, requires an increased investment and additional operation costs. Therefore, it has already been suggested that the fuel gas needed as a reduction agent is made available by gasifiying a corresponding amount of fuel extracted from the primary fuel (DE-OS No. 34 13 564).

However, in most cases the configuration of a reduction area following the performance combustion area is insufficient to comply with the existing emission guidelines, or to obtain values below these those established by the regulations, thus making it necessary to set up additional costly and complicated secondary devices to comply with the prescribed NOX emission values.

The task of the present invention consists in creating a process of the type described above and of a unit that is appropriate for its implementation. It will allow a further reduction of the nitrogen oxide emissions, and will, thus, avoid an investment in secondary measures.

According to the invention this task is solved by partially or completely degasifiying the entire amount of solid fuel before it is burned.

The degasified solid fuel is appropriately burned inside a performance combustion area with the use of primary measures, such as air staging.

For the separation of the gaseous components contained in the solid fuel, that is, of the so-called volatile components, the combustion chamber temperature of the performance combustion area can be changed, and, thus, the NOX concentration in the performance combustion area may be reduced. Also, only the residual nitrogen contained in the degasified solid fuel reaches the performance combustion area, while the nitrogen separated with the gases does not reach the performance combustion area any more and, therefore, cannot contribute to the formation of NOX. In the case of proper combustion management, the degasified residual fuel, due to its porous structure, (compared to the original material, bituminous coal) shows lower NOX generation values, and, at the same time, produces reducing effects. Lower combustion temperatures have an effect of the thermal NOX formation.

According to the present state of the art a relative proportion of the NOX formed in the performance combustion area is reduced in the reduction area.

Therefore, from the start it is very important to reduce, as far as possible, the amount of NOX generated in the performance combustion area.

The process according to the invention is especially suited for the combustion of medium and highly volatile coal. The solid fuel to be burned is degasified until a degasified and ignitible solid fuel remains and until a low NOX concentration is obtained in the performance combustion area.

Part of the combustible gas extracted during the degasification of the solid fuel is appropriately used in the reduction area itself. Any remaining gas excess can be removed from the unit and may be used elsewhere. Under certain conditions, instead of NOX, other additional reduction gas components are generated from the nitrogen fuel produced from the fuel gas.

Preferably, the reduction area is confined by the addition of air in the direction of flow of the flue gases, and the combustible reduction gases remaining following the reduction area are burned. It may also be appropriate to configure several reduction areas, one following the next, in the direction of flow of the flue gases.

The heat energy necessary for the reduction of the solid fuel may be extracted, at least partially, from the combustion process or from the flue gases in the performance combustion area, all the way down to flue gas temperatures of approximately 180° C. to 1000° C. In the case of adding gas containing oxygen the heat energy necessary for the degasification of the solid fuel may be obtained from the partial extraction of heat generated by the solid fuel.

A device for the implementation of the process according to the invention is characterized by configuring the degasification device as a degasification section arranged for the continuous passage of fuel inside the combustion device and arranged within the fuel gas current. This makes it possible to utilize the heat contained in the flue gases for the degasification of the solid fuel, without having to set up additional devices. On the other hand, the gases separated from the fuel can be fed, completely or partially, to the reduction areas by way of the gas exhausts placed along the degasification section. In this case, depending on the requirements, it is possible to set up a gas feed with a varying distribution via the flue gas cross-section and the height of the combustion chamber. It might also be possible to provide several degasification sections that can be fed with solid fuel, that are independent from one another.

Essentially, the degasification device may also be configured outside of the combustion device. However, this arrangement necessitates additional requirements, such as, for example, devices for the utilization of the heat generated during combustion that is needed for the degasification of the solid fuel.

Figure 2:
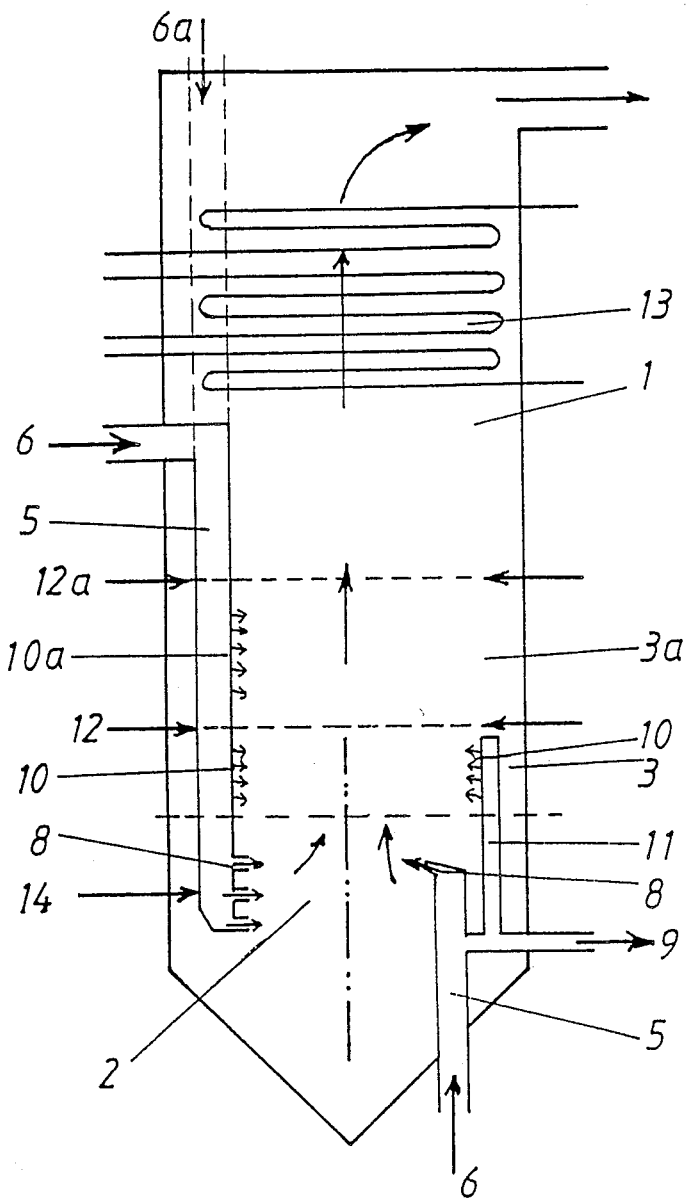

The process according to the invention, and the devices for the implementation of the same, are explained in greater detail with the aid of a molten ash chamber combustion unit illustrated in FIG. 1 and with a dry bed combustion unit, shown in FIG. 2.

A combustion device 1 according to the invention has been provided with a performance combustion area 2 and with one or several reduction areas 3 that are placed one following the next. Inside the combustion device 1 a degasification section 5 has been arranged in the direction of flow of the flue gases. Fresh solid fuel is fed into the degasification section 5 via feed line 6. The solid fuel is degasified in the degasification section 5 by the heat energy taken from the flue gases circulating around the degasification section 5. The degasified solid fuel is fed to the burners 8 inside the performance combustion area 2 via feed line 7 and is burned there.

At least part of the combustion gas obtained in the degasification section 5 is utilized as combustion gas and is distributed over one or several reduction areas 3. Any excess gas can be extracted via pipe 9.

In the example illustrated in FIG. 1, the flue gases of the performance combustion area 2 are deflected by 180° into a molten ash chamber unit and are passed through a catching grate 4. The deflected flue gas current then flows through a degasification section 5 that, in the implementation example, is placed transversely to the direction of flow of the flue gases. The flue gas current transfers the heat energy necessary for the degasification of the solid fuel to the degasification section. The reduction gas for the reduction area 3 (in the case of several reduction areas, the segment required for the first reduction area 3) may be fed into the reduction area 3 by way of the gas exhausts 10 placed inside the degasification section 5. Especially in the case of several reduction areas 3, separate exhaust lines 11 may be provided.

The reduction area 3 is confined by the addition of air at 12 in the direction of flow of the flue gases and any still available combustible reduction gases are burned.

In the example of a dry bed combustion unit, such as shown in FIG. 2, the degasification section 5 has been arranged in the direction of flow of the flue gases and reduction areas 3 and **3*a*** also have been provided.

The solid fuel is fed in via feed line 6 and **6*a* and the degasified fuel is burned with the addition of combustion air 14 in burners 8 of the performance combustion area 2. The combustion gases obtained are fed as reduction gases into reaction area 3 and 3*a*. Reduction areas 3 and 3*a* are confined by the addition of air 12, 12*a*. In the left half of the example illustrated in FIG. 2 the degasification section 5 has been arranged inside the reduction area and the solid fuel to be degasified is fed from top to bottom. The reduction gas exits into the reduction area 3 and 3*a* through gas exhausts 10 and 10*a* placed inside the degasification section. The degasification section 5 may (dotted line) also be led along the entire height of the device, beyond the range of the steam generator. The fuel feed is implemented via feed line 6*a***.

In the right half of the illustration shown in FIG. 2 the degasification section 5 has been configured inside the performance combustion area and the solid fuel to be degasified is fed in from bottom to top. The generated gas is fed into the reduction area 3 by way of feed line 11. Any excess gas may be extracted via line 9.

What is claimed is:

1. Process for the reduction of nitrogen oxide emissions produced during the combustion of medium and highly volatile bituminous fuels, in which at least one reduction area for nitrogen oxides is arranged following every performance combustion area, comprising the steps of partially or fully degassing the entire solid fuel prior to combustion and using gas extracted from the solid fuel as a reduction gas in the reduction area.

2. Process according to claim 1, characterized by the fact that the partially or fully degasified fuel is burned in the performance combustion area with primary measures, such as with air staging.

3. Process according to claim 1, characterized by the fact that, in direction of flow of the flue gases, the length of the reduction area is confined by the addition of air; and that the combustion reduction gases are burned following the reduction area.

4. Process according to claim 1, characterized by configuring several reduction areas, one following the next, in the direction of flow of the flue gases.

5. Process according to claim 1, characterized by the fact that the heat energy necessary for the degasification of the fuel is, at least partially, extracted from the combustion and/or flue gases generated in the performance combustion area.

6. Process according to claim 1, characterized by the fact that the heat energy necessary for the degasification of the fuel is made available, at least partially, by heat extraction from the same fuel.

7. Unit for carrying out the process according to claim 1, provided with a combustion unit consisting of:

a performance combustion area a reduction area, and a degasification device for solid fuel, wherein the degasification device is provided with an exhaust for degasified solid fuel as well as with exhausts for gas, characterized by the fact, that the degasification device is configured as a degasification section (5) placed in a combustion unit (1) within a stream of flue gas downstream of the performance combustion area, the exhaust (7) of the degasification section (5) for the degasified solid fuel being connected with a fuel feed of the performance combustion area (2), and wherein at least one of the gas exhausts is connected to the reduction area in order that the gas extracted from the solid fuel may be used as a reduction gas in the reduction area.

8. Device according to claim 7, wherein the gas exhausts are located in a wall of the degasification section.

9. Unit for carrying out the process according to claim 1, provided with a combustion unit consisting of:

a performance combustion area a reduction area, and a degasification device for bituminous fuel, wherein the degasification device is provided with an exhaust for degasified fuel as well as with exhausts for gas, characterized by the fact, that the degasification device is configured as a degasification section (5) placed in a combustion unit (1) within a stream of flue gas downstream of the performance combustion area, the exhaust (7) of the degasification section (5) for the degasified fuel being connected with a fuel feed in the performance combustion area (2), and wherein at least one of the gas exhausts is connected to the reduction area in order that the gas extracted from the solid fuel may be used as a reduction gas in the reduction area, and characterized by configuring several degasification sections (5) that can be fed with solid fuel independently from one another.

10. Process for the reduction of nitrogen oxide emissions produced during combustion of medium and highly volatile bituminous coal, in which at least one reduction area for nitrogen oxides is arranged following every performance combustion area, characterized by the feeding the bituminous fuel in a feed line to a degasification section of the feed line located within a flue containing gaseous products of the combustion area, partially or fully degasifying the entire fuel prior to combustion and releasing gas from the degasification section into flue gas from the combustion area that is in the reduction area, and reducing nitrogen oxides in the reduction area.

11. Process according to claim 10, characterized by combusting part of the degasified fuel, or the entire degasified fuel, in the performance combustion area with primary measures, such as air staging.

12. Process according to claim 10, characterized by immediately releasing into the reduction area gas extracted from the bituminous fuel in the degasification section which passes through the reduction area.

13. Process according to claim 10, characterized by confining the reduction area by adding air into flue gas flowing out of the reduction area and burning combustible gases which flow out of the reduction area.

14. Process according to claim 12, characterized configuring several reduction areas, one following the next, in the direction of flow of the flue gas, and releasing reduction gas from the degasification section directly into the several reduction areas.

15. Process according to claim 10, characterized by at least partially extracting from combustion products generated in the combustion area the heat energy necessary for degasification of the solid fuels.

16. Process according to claim 10, characterized by the fact that the heat energy necessary for the degasification of the bituminous fuel is made available, at least partially, by the heat extraction from the same bituminous fuel.

17. Apparatus of the implementation of the process according to claim 2, comprising a combustion unit consisting of a combustion area, a fuel feed in the combustion area, a gas feed in the combustion area, a flue carrying gaseous combustion products from the combustion area, characterized by a fuel feed line having a degasification section within the flue for heating bituminous fuel in the gasification section with gaseous combustion products, and gas exhausts for releasing gas from the degasified bituminous fuel into the reduction area for reducing nitrogen oxide components of the gaseous combustion products in the reduction area.

18. Apparatus according to claim 17, further characterized by the degasification section being positioned in the reduction area and the gas exhausts comprising openings in the degasification section for flowing reduction gas from the degasification section directly into the reduction area.

19. Apparatus according to claim 17, further characterized by oxygen introducing means downstream of the reduction area for confining the reduction gases to the reduction area and burning combustible materials in the flue following the flowing of gas through the reduction area.

* * * * *